US008291984B2

(12) United States Patent
Saltel

(10) Patent No.: US 8,291,984 B2
(45) Date of Patent: Oct. 23, 2012

(54) CONTROL DEVICE FOR AN INFLATABLE TOOL FOR THE TREATMENT OF A WELL OR A PIPELINE

(75) Inventor: Jean-Louis Saltel, Le Rheu (FR)

(73) Assignee: Saltel Industries (FR)

( * ) Notice: Subject to any disclaimer, the term of this patent is extended or adjusted under 35 U.S.C. 154(b) by 345 days.

(21) Appl. No.: 12/738,354

(22) PCT Filed: Sep. 29, 2008

(86) PCT No.: PCT/EP2008/063043

§ 371 (c)(1),
(2), (4) Date: Apr. 16, 2010

(87) PCT Pub. No.: WO2009/050030

PCT Pub. Date: Apr. 23, 2009

(65) Prior Publication Data

US 2010/0243234 A1 Sep. 30, 2010

(30) Foreign Application Priority Data

Oct. 17, 2007 (FR) ..... 07 07264

(51) Int. Cl.
*E21B 33/12* (2006.01)
*E21B 34/10* (2006.01)

(52) U.S. Cl. ..... 166/374; 166/319

(58) Field of Classification Search ..... 166/374, 166/319, 187, 101

See application file for complete search history.

(56) References Cited

U.S. PATENT DOCUMENTS

| | | | | |
|---|---|---|---|---|
| 2,231,425 | A | 2/1941 | Johnston | |
| 3,419,075 | A | 12/1968 | Brown | |
| 3,908,769 | A * | 9/1975 | Schuyf et al. | 175/48 |
| 2003/0183398 | A1 | 10/2003 | Smith et al. | |

FOREIGN PATENT DOCUMENTS

GB 2349657 A 11/2000

OTHER PUBLICATIONS

International Search Report, PCT/EP2008/063043, dated Apr. 14, 2009.

* cited by examiner

*Primary Examiner* — Brad Harcourt
(74) *Attorney, Agent, or Firm* — Lerner, David, Littenberg, Krumholz & Mentlik, LLP

(57) ABSTRACT

The invention relates to device for controlling an inflatable tool used to treat a well or pipeline. The device, which is inserted between the outlet of a fluid supply pipe and the tool, comprises: a chamber communicating with the exterior through a tube and with the tool via a pipeline; and a piston mounted in said chamber, which, under the force of a spring, normally occupies a first position in which it seals the outlet of the pipe, the aforementioned tube then communicating with the pipeline. The pipeline is provided with at least one spring-loaded check valve which allows the passage of the pressurized fluid from the chamber to the tool when the pressure upstream of the valve exceeds a predetermined threshold value, which prevents the passage of the fluid in the opposite direction.

2 Claims, 4 Drawing Sheets

Figures 1A, 1B, 1C:
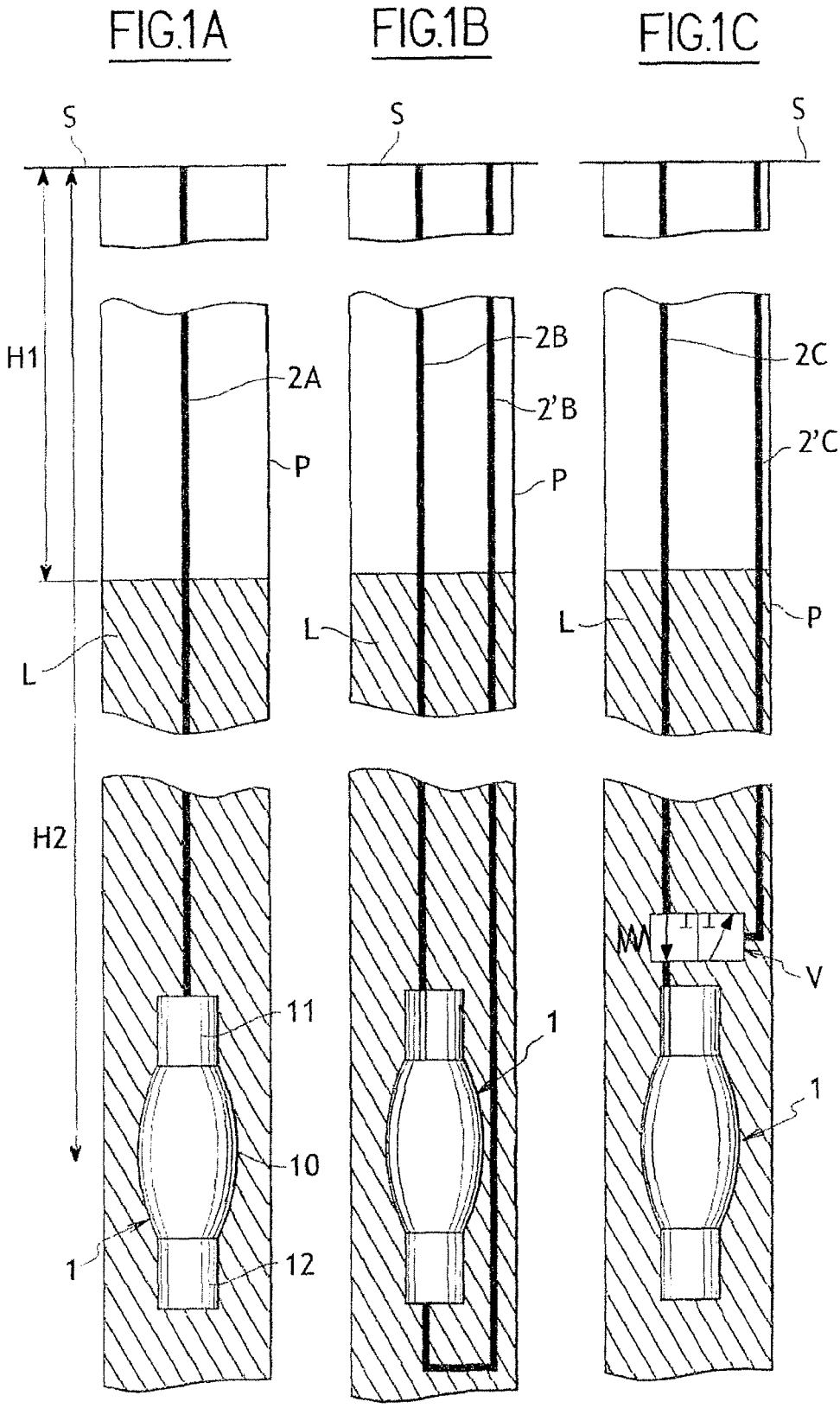

S
S
S
H1
2A
P
L
2B
2'B
P
L
2C
2'C
P
L
H2
11
10
1
12
1
V
1

CONTROL DEVICE FOR AN INFLATABLE TOOL FOR THE TREATMENT OF A WELL OR A PIPELINE

CROSS-REFERENCE TO RELATED APPLICATIONS

This application is a national phase entry under 35 U.S.C. §371 of International Application No. PCT/EP2008/063043, filed Sep. 29, 2008, published in French, which claims the benefit of the filing date of French patent application Ser. No. 07/07264 filed on Oct. 17, 2007, the entire disclosures of which are hereby incorporated herein by reference.

The present invention concerns a tool in the form of an inflatable bladder that is used for the treatment of a well or a pipe, such as the lining of a shaft for example.

More particularly, its purpose is to control the inflation and deflation of said bladder.

It can be applied particularly, but not obligatorily, to the field of water production or oil production, in which this type of tool is usually referred to by the English term "packer".

Such a tool includes a flexible and elastic annular membrane, mounted on a spindle, that is able to dilate radially under the action of an internal pressure developed by a fluid, generally a liquid, which is introduced within the membrane and raised to a high pressure.

It can be used in particular as a plug to temporarily isolate two portions of the well or pipe from each other. In this case, with the tool having been introduced axially and positioned in the zone separating said portions, it is inflated so that its membrane is pressed intimately against the inside wall of the well or pipe, closing it off.

It can also be used as a hydraulic forming tool that is used to line or jacket a portion of the wall of the well or pipe. In this case, the bladder is introduced axially inside a radially expandable tube, made of steel for example, whose outside diameter is slightly less than the inside diameter of the portion to be treated. When the tool is inflated, its wall dilates radially and causes the radial expansion of the tube that surrounds it, forcing the wall of the latter to deform plastically (beyond its elastic limit), and to be flattened against the inside wall of the well or pipe. After deflation of the bladder, the latter can be withdrawn, but the tube remains applied against the wall of the well or pipe and forms an internal lining.

This technique is used in particular to repair damaged portions of a shaft lining.

It has also been proposed for step-by-step jacketing of a large portion of the length of the well or pipe, or even all of its length, by means of a jacket or lining which is expanded in successive sections.

The state of the art in this area can be illustrated by the English-language technical document from the Australian IPI company (Inflatable Packers International Pty Ltd) entitled "Slim-line Re-lining", dated 30 Jun. 2000, as well as by document EP-A-1 657 365.

This is accomplished by inserting into the well or pipe to be jacketed a tube of considerable length, formed of sections of tube that have been previously attached end-to-end, and then by arranging for the radial expansion of the tube, over all of its length, so that its wall is pressed against that of the well or pipe; this expansion is effected by a sequence of successive placements of the inflatable bladder along the length of the tube with, in each position, a process of crimping by inflation of the bladder, and then deflation of the latter in order to move it to a position adjacent to the previous one, and so on all along the length of the tube.

Regardless of the use that is made of the inflatable bladder, either as a plug, or as a tool for jacketing or lining by hydroforming, it is often necessary to develop a very high pressure within the bladder in order that it can be inflated.

This is particularly true when the well or pipe contains a liquid and the treatment to be effected has to be carried out at a great depth below the level of this liquid. In fact, in this case, the hydrostatic pressure that exists outside of the membrane is high, since it is proportional to the height of the liquid column above it. Now, in order to be able to inflate the bladder, and where appropriate to also dilate the jacketing tube, it is obviously necessary to develop a pressure within the bladder that is greater than this hydrostatic pressure which opposes its radial expansion.

In order to control the inflation of an inflatable bladder that has first been lowered to a certain depth within a well, in particular an oil production well, a first technique consists of generating the pressure inside the well itself by means of an ad-hoc submerged system.

This technique is generally effective, but can give rise to safety problems whenever inflammable gases are present in the well.

According to a second technique, the pressurised fluid is generated at the surface of the well and applied to the bladder by the use of appropriate transfer means.

In this regard, to the knowledge of the applicant there exist three possible configurations, which are illustrated in the diagrams comprising FIGS. 1A, 1B and 1C of figure set 1 attached.

These figures are therefore representative of the state of the art.

In these, reference P indicates the wall of the well, which is vertical, reference S the surface of the ground in which the well is sunk, reference L the liquid that is present in the lower part of the well, and reference $H_1$ the height of air above the liquid level.

Reference 1 refers to a tool in the form of an inflatable bladder that includes a flexible and elastic annular membrane, which is expandable radially, supported on top 11 and bottom 12 end ferrules.

In its deflated state, this tool has been lowered inside the well into a zone to be treated that is located submerged in liquid L, at depth $H_2$.

The tool is therefore surrounded by a liquid whose pressure is proportional to liquid height $H_2$-$H_1$.

In the configuration illustrated in FIG. 1A, the feed to the tool 1 of inflation fluid, which in this case is liquid (water, for example) is effected via a single conduit 2A from the surface S.

In the configuration illustrated in FIG. 1B, this feed is provided by a pair of non-communicating conduits 2B and 2'B, in which the fluid circulates. One of the two paths is used only for controlling the deflation.

In the configuration illustrated in FIG. 1C, the feed to the tool 1 is also effected by means of a pair of conduits 2C and 2'C, which are communicating in this case. One of the paths (2C) communicates with the tool via a pneumatically-controlled valve V, operated by the (gaseous) fluid supplied via the other path (2'C).

The first solution (FIG. 1A) has the drawback that it is not possible to deflate the tool when the dry column (corresponding to height $H_1$) is too large. In fact, the liquid column contained in the conduit 2A generates a pressure in the tool that is excessively high in relation to the external pressure, which prevents deflation.

The second solution (FIG. 1B) overcomes this difficulty by circulation of the fluid according to the principle of communicating vessels. For deep wells however, the time required for this transfer is excessively long.

The third solution (FIG. 1C) is satisfactory in principle, since it allows working at great depth and in a relatively rapid manner.

However this solution, like the second, has the disadvantage of requiring a double connection with the ground, since it needs two separate feed conduits. This causes the technique laborious and expensive at very large depths and/or when the subterranean formation is convoluted.

Whatever the configuration employed, it is best to take into consideration not only the column heights of the fluids in the well, and in the bladder of course, but also their density, so that the differential pressures allow inflation or deflation to be achieved.

The objective of the invention is to propose a control device for the inflation and deflation of the tool, that can work with a single and unique path for connection with the surface, while also being of simple and robust design, easy to use, and capable of working effectively even at great depths, regardless of the differential pressure between the spaces inside and outside the membrane.

This device is therefore connected to a single pressurised fluid feed conduit, and is positioned between the output of this conduit and a ferrule attached to the tool, by which the entry and the exit of the fluid takes place in order to control inflation and deflation.

It consists of an enclosure within which is located a piston driven by a spring, with this enclosure communicating firstly with the exterior by means of a tube or a simple bleed orifice, and secondly via at least one pipe with said ferrule, with said piston and said enclosure thus being arranged so that:

under the action of said spring, said piston normally occupies a first position in which it closes off the output of said feed conduit, with said tube or bleed orifice then communicating with said pipe via the chambers of the enclosure;

when the pressure of the fluid present in the output zone of said feed conduit exceeds a specified threshold value, the piston is moved against the force of said spring so that it occupies a second position in which said tube or bleed orifice is isolated, when the feed conduit then communicates with the pipe via a chamber of the enclosure.

The state of the art in this area can be illustrated by document US-2003/183398, which describes a valve system with these characteristics.

According to the invention, said pipe is fitted with at least one first non-return valve, with pre-loaded spring, which allows the passage of the pressurised fluid from the enclosure toward the tool when the pressure upstream of the valve exceeds a specified threshold value, and only in this case, and that prohibits the passage of the fluid in the other direction.

In addition, according to one advantageous embodiment of the invention, this pipe has at least two branches mounted in parallel, one of which is fitted with said first non-return valve, and the other of which is fitted with a second non-return valve, with the latter allowing the passage of the fluid from the tool toward the enclosure when the pressure on the tool side is equal to or greater than the pressure on the enclosure side, and only in this case, and that prohibits the passage of the fluid in the other direction.

Other characteristics and advantages of the invention will appear on reading the description that now follows, with reference to the annexed drawings, in which:

FIGS. 1A-C depict prior art devices indicating the state of the art, as specified previously.

Figure 2:
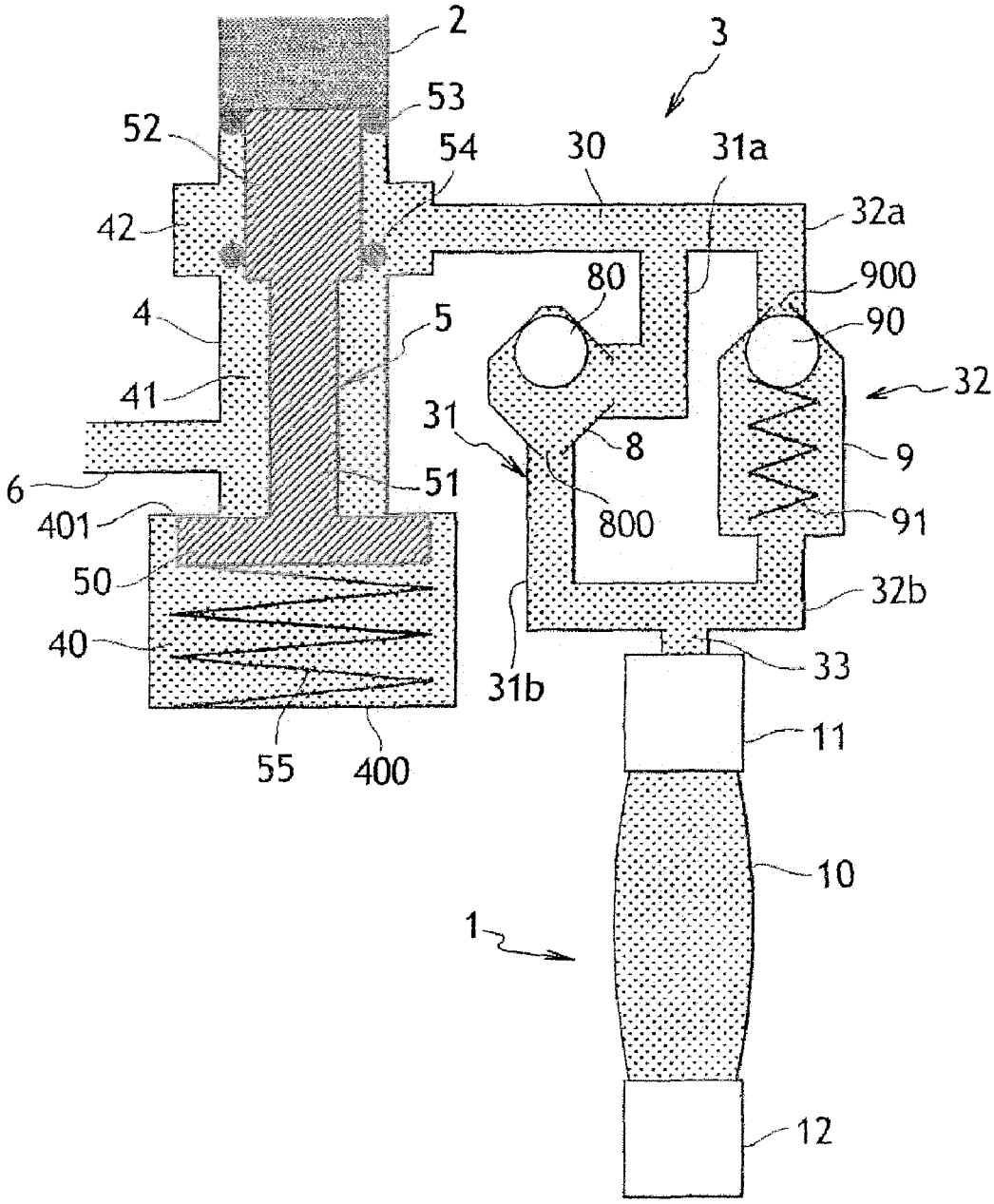

FIG. 2 schematically represents one possible embodiment of the device of the invention, shown at rest before or after an operation for inflation of the tool.

Figure 3:
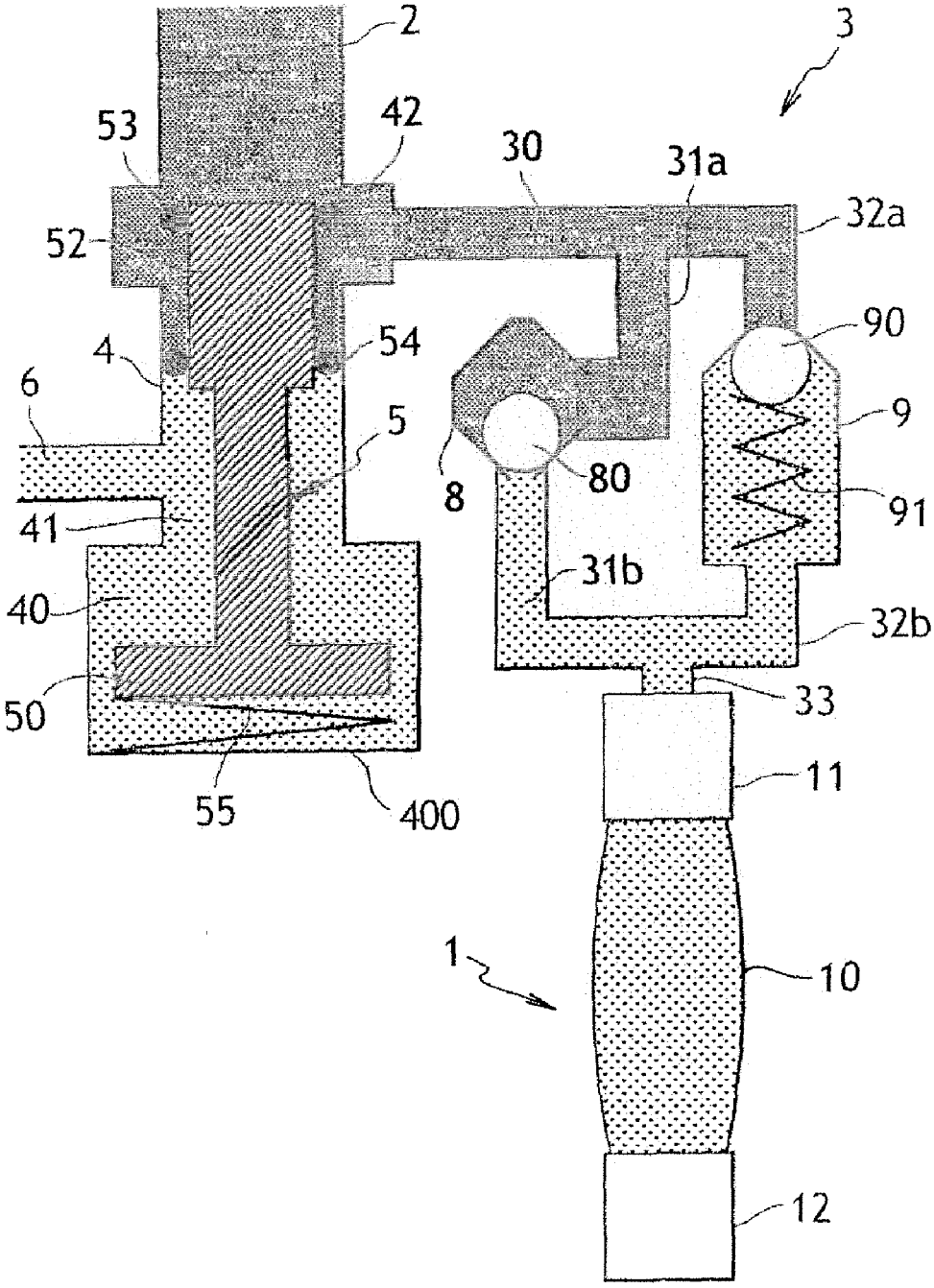
Figure 4:
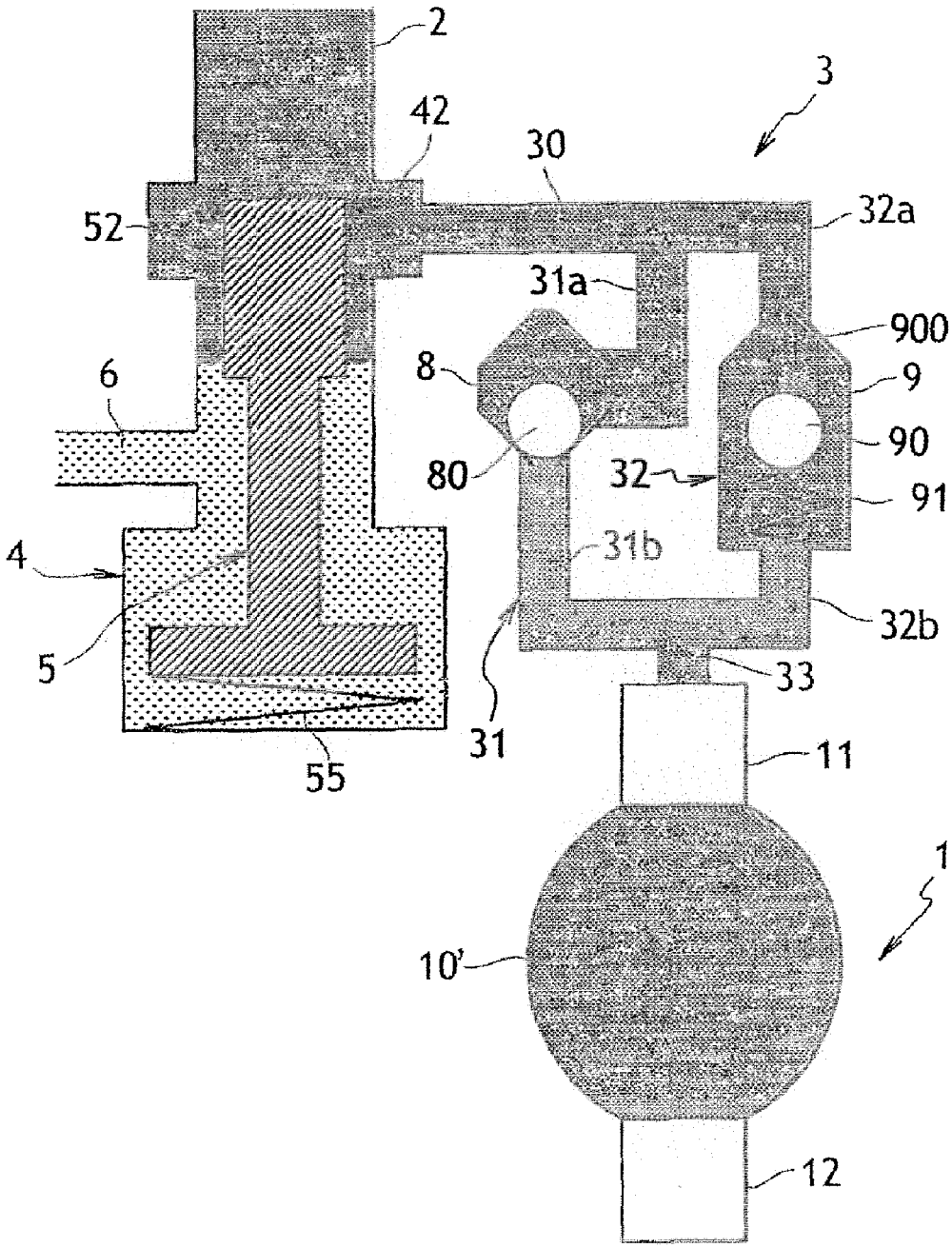

FIGS. 3 and 4 are diagrams similar to that of FIG. 2, respectively at the beginning of and during the operation.

In order to facilitate the reading and comprehension of the drawings, the scale of the device has been enlarged disproportionately here in relation to that of the tool (1) to which it is coupled.

This device, known by the reference 3, is mounted at the bottom end of the vertical conduit (2) for feeding of the inflation fluid, and interposed between the latter and the upper ferrule (11) of the tool (1). The ferrule (11) is tubular and allows passage of the liquid into the membrane (10). The other ferrule (12) is a solid element, acting as a capping plug. The two ferrules 11 and 12 are advantageously guided in axial translation so that they are able to move toward or away from each other when the bladder is inflated or deflated respectively.

This device 3 includes a tubular enclosure 4, fitted in a sealed manner to the end of conduit 2 and coaxially to the latter. At the bottom, the enclosure 4 is closed off by a flat bottom wall 400.

In the axial direction, from the bottom to the top, its lateral cylindrical wall has diameter variations that delimit three communicating chambers, namely:

- the bottom, large-diameter chamber 40, closed by the aforementioned bottom 400;
- the central, small-diameter chamber 41, whose diameter is equal to that of the conduit 2;
- the top, medium-diameter chamber 42, which opens into the conduit 2.

Inside this enclosure 4, and guided vertically, in axial translation, is mounted a piston 5 whose head 50 is located in the bottom chamber 40 with the piston rod 51 in the central chamber 41. The top end of this piston rod has a cylindrical portion of greater diameter 52; this portion is equipped with a pair of sealing o-rings 53 and 54 which are offset axially.

Their diameter is such that they are able to slide in a sealed manner against the cylindrical inside wall of the conduit 2 or of the chamber 41.

A pre-loaded helical compression spring 55 is located in the bottom chamber 40 and positioned between the bottom 400 and the piston head 50 so as to push the latter upwards, into the position illustrated in FIG. 2.

The piston head 50 presses against the horizontal annular zone 401 which marks the transition between the bottom 40 and central 41 chambers.

In this position, the top o-ring 53 surrounding portion 52 is applied against the inside wall of the conduit 2, while the bottom o-ring 54 is then positioned in the top chamber 42.

The central chamber 41 communicates with the exterior via a horizontal tube 6 of short length, positioned radially in relation to the median vertical axis of the enclosure 4. This communication could take place just as well via one or more orifices created in the wall of chamber 41.

The top chamber 42 communicates with the tubular ferrule 11 of the tool 1 by means of pipes that include a first main tube 30, two secondary tubes 31 and 32 connected in parallel, and a second main tube 33.

The tube 31 goes through a non-return valve 8 fitted with a ball 80 that is capable of closing off the output orifice 800. The portions of tube 31 located upstream and downstream of this valve, considering the direction of flow of the fluid from chamber 42 toward the inflatable bladder 1, bear the references 31*a* and 31*b* respectively.

In a similar manner, the tube 32 traverses a non-return valve 9 fitted with a ball 90 that is capable of closing off the input orifice 900 and the portions of tube 32 located upstream and downstream of this valve respectively bear the references 32*a* and 32*b*.

The ball 80 is pressed downwards against the seat of valve 8, closing off its passage orifice 800, when the fluid pressure in the upstream portion 31*a* is greater than the fluid pressure in the downstream portion 31*b*; conversely, it rises and frees the orifice 800 if the fluid pressure in the upstream portion 31*a* is equal to or less than to the fluid pressure in the downstream portion 31*b*. The fluid can then pass through this orifice (from the bottom to the top in the figures).

The ball 90 is forced upwards by a pre-loaded spring so that it is applied normally against the seat of valve 9, thus closing off its passage orifice 900. When the fluid pressure in the upstream portion 32*a* is significantly greater than the fluid pressure in the downstream portion 32*b*, and exceeds a specified threshold that is sufficient to overcome the thrust of this spring 91, then the ball 90 is moved away from its seat and the orifice 900 then allows passage of the fluid, from upstream to downstream (top to bottom in the figures), in the tube 32; conversely, as long as the fluid pressure in the upstream portion 32*a* is less than this threshold value, then the orifice 900 of the valve 9 is closed off, and passage of the fluid in the tube 32 is prohibited in both directions.

The operation of this device will now be explained with reference to FIGS. 2 to 4.

The inflatable tool 1, as well as the device 3 to which it is attached, are lowered into the well to the desired depth.

The fluid pressure generated in the conduit 2 that connects the device to the surface of the well is sufficiently low so that it does not push back the piston 5 which, under the action of the spring 55, occupies its up position, illustrated in FIG. 2. In this position, the tube 6 that communicates with the interior of the well also communicates with the tube 30 via chambers 41 and 42 of enclosure 4.

The membrane of the bladder is subjected to an external pressure due to the liquid present in the well which is the same as its internal pressure, delivered by tubes 31 and 33, with valve 8 therefore necessarily being open.

The inflatable bladder 1 having been placed in its working area at which the well is to be treated, it is then possible to expand it.

To this end, one begins by increasing (from the surface) the pressure of the fluid in the conduit 2 so that it exceeds the pressure that exists in the well, and so that it is sufficient to fully displace the piston 5 downwards (to its limit of travel), compressing spring 55. O-ring 54 then takes up position in chamber 41, cutting off communication between chambers 42 and 41, and therefore also between tubes 6 and 30.

For its part, gasket 53 takes up position in chamber 42, and communication is therefore established between conduit 2 and tube 30.

The pressurised fluid present in tube 30 and in the upstream portions 31*a* and 32*a* of branches 31 and 32 respectively, being greater than the hydrostatic pressure in the well to which the membrane (10) is subjected, it is also greater than the internal pressure of the tool, which is equal to this hydrostatic pressure.

Valve 8 is therefore closed.

This also applies to valve 9, since the pressure applied at this stage in the conduit 2 and tubes 30 and 32*a*, is insufficient to force back the spring 91.

In this intermediate situation, illustrated in FIG. 3, the piston 5 is in a position of equilibrium.

This position is stable and free of any parasitic vibration phenomena, since the spring 55 controls and determines the pressure in the system, upstream of the valves 8 and 9.

Inflation of the bladder can then take place.

To this end, the fluid pressure generated in the conduit 2 is again increased, sufficiently to force ball 90 back against spring 91, and to open valve 9. The fluid can then pass into tube 32 and pass into the bladder 1 via tube 33 and ferrule 11.

The differential pressure between the interior and the exterior of the membrane, shown inflated and referenced 10' in FIG. 4, is chosen to be sufficient to cause the radial expansion of this membrane and to perform the desired work, such as tubing or lining of the well for example.

It will be seen that during this phase, the high pressure developed in the bladder is also to be found in the downstream portion 31*b* of tube branch 31; this is of no importance and has no effect on the operation of the device, since the pressure is the same in portion 31*a*, upstream of valve 8.

When the work has been completed, the bladder 1 is deflated.

To this end, it is only necessary to reduce the excess pressure in the conduit 2 for this pressure to return to its initial value of FIG. 2.

The latter, which corresponds to the column of water present in conduit 2 for example, is insufficient to keep spring 55 pressed down, so that the piston 5 rises to its initial position.

Thus, tube 30 is again put in communication with bleed tube 6, and therefore set to the pressure of the well. This allows the high-pressure fluid present in the tool to dissipate rapidly into the well via tubes 33, 31 and 30, chambers 42 and 4, and finally tube 6.

At the same time, the spring 91 has returned the ball 90 to its position of closure of valve 9.

This bleed or fluid transfer, which concerns only a small volume of fluid, can take place very rapidly.

The fluid present in the conduit 2 is preserved, and the device is immediately ready for a similar new operation.

The values of the springs 55 and 91 are naturally chosen as a function of their working conditions, in particular the values of the pressures employed and the depth of the zone to be treated, which themselves are a function of the aforementioned heights $H_2$ and $H_1$.

Advantageously, the device can be fitted with means for adjusting the force exerted by these springs, so that it can be adapted easily to these conditions.

The invention claimed is:

1. A control device for a tool in the form of an inflatable bladder for the treatment of a well or a pipe, which is connected to a single pressurised fluid feed conduit, and positioned between an output of the conduit and a ferrule attached to the tool, through which entry and exit of fluid is controlled in order to control inflation and deflation of the bladder, the control device comprising an enclosure within which is located a piston driven by a spring, the enclosure communicating with an exterior of the device, firstly by means of a tube or bleed orifice, and secondly via at least one pipe, said ferrule, said piston and said enclosure being arranged so that:

said piston normally occupies a first position, under action of said spring, in which it closes off the output of said feed conduit, with said tube or bleed orifice communicating with said pipe via chambers of the enclosure;

wherein, when pressure generated by the fluid present in said feed conduit exceeds a specified threshold value, said piston is moved against said spring so that it occupies a second position, in which said tube or bleed orifice is isolated, while said feed conduit communicates with said pipe via at least one of the chambers of the enclosure, and wherein said pipe is fitted with at least one first non-return valve, with a pre-loaded spring, which allows the passage of the pressurised fluid from one of the enclosures to the tool when pressure upstream of the valve exceeds a specified threshold value, and only in this case, and that prohibits the passage of the fluid in an opposing direction.

2. A control device according to claim 1, wherein said pipe has at least two branches mounted in parallel, one of which is fitted with said first non-return valve, and the other of which is fitted with a second non-return valve, the second non-return valve allowing passage of fluid toward the one enclosure when pressure on the tool side is equal to or greater than the pressure on the enclosure side, and only in this case, and that prohibits the passage of the fluid in an opposing direction.

* * * * *